United States Patent [19]

Hall

[11] Patent Number: 5,058,571

[45] Date of Patent: Oct. 22, 1991

[54] HAND-HELD GYROSCOPIC DEVICE

[76] Inventor: William D. Hall, 10850 Stanmore Dr., Potomac, Md. 20854

[21] Appl. No.: 468,156

[22] Filed: Jan. 22, 1990

[51] Int. Cl.[5] ..... A61H 1/00; A61H 7/00

[52] U.S. Cl. ..... 128/46; 128/36

[58] Field of Search ..... 128/46, 36

[56] References Cited

U.S. PATENT DOCUMENTS

| | | | |
|---|---|---|---|
| 2,181,282 | 11/1939 | Oster | 128/36 |
| 2,703,571 | 3/1955 | Thomas | 28/36 |
| 4,684,124 | 8/1987 | Escher | 128/46 |

*Primary Examiner*—Edgar S. Burr
*Assistant Examiner*—Lisa E. Malvaso
*Attorney, Agent, or Firm*—William D. Hall

[57] ABSTRACT

A gyroscope is firmly held against the back side of the human hand to reduce or eliminate the effect of naturally occurring tremors such as essential tremor or other tremor. The gyroscope is driven by an electric motor energized by batteries. The batteries are mounted near the periphery of the gyroscope to enhance the gyroscopic action. In a modified form of the invention the motor is not mounted on the back side of the hand but is a separate unit to which the gyroscope can be readily coupled and uncoupled.

20 Claims, 2 Drawing Sheets

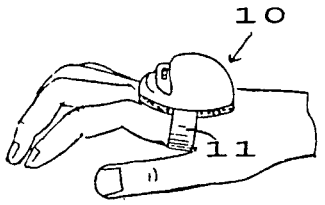
Fig. 1
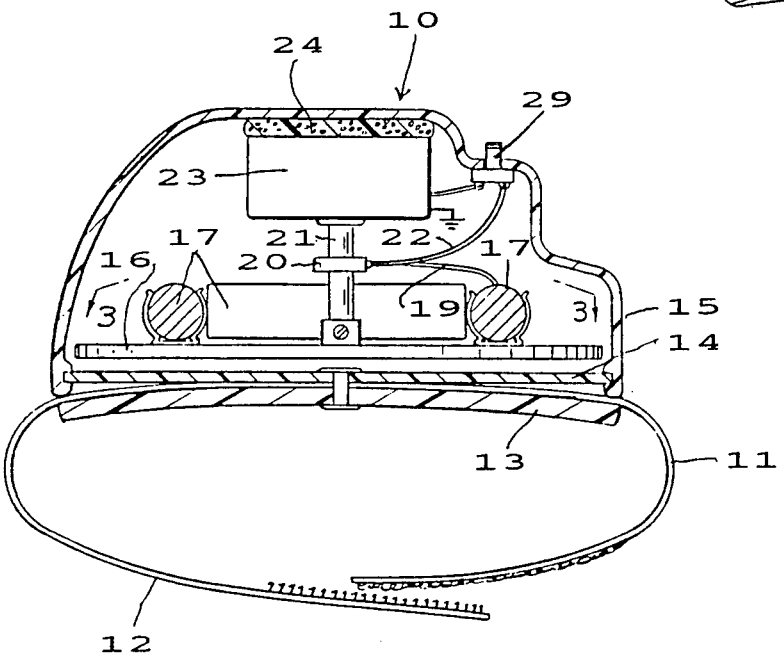
Fig. 2
Fig. 3
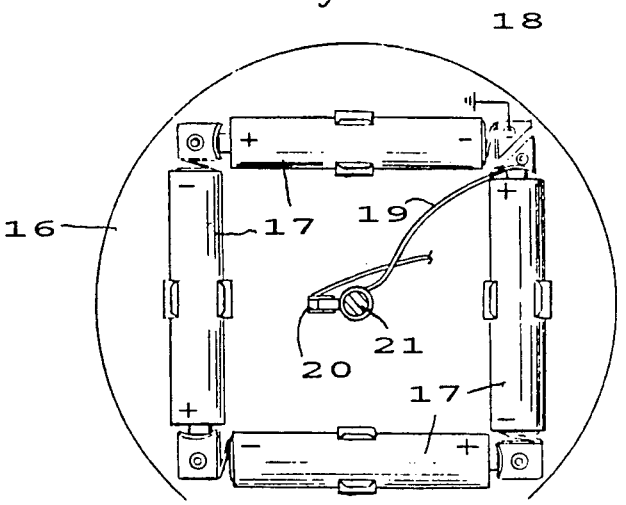

HAND-HELD GYROSCOPIC DEVICE

BACKGROUND OF THE INVENTION

There is a disease known as "essential tremor" which may involve a tremor in the right hand of a right-handed person or in the left hand of a left-handed person. The effect of the tremor might not impair the person from driving a nail with a hammer but yet might affect delicate work. For example, persons afflicted with essential tremor may not be be able to hold a cup of water without spilling it and may not be able to use a spoon to move soup from a bowl to the mouth.

SUMMARY OF THE INVENTION

In one form of the invention a battery-driven gyroscope is mounted on the back of the hand and rotates at high speed. The batteries are mounted on the rotating part of the gyroscope and add to the gyroscopic action.

Another form of the invention employs a gyroscope firmly attached to the back of the hand but without a motor carried by the hand. The motor is mounted on a table where it is readily accessible to the hand held gyroscope. There is a coupling that enables the gyroscope to be driven by the motor. The gyroscope may hold the hand steady long enough to perform a simple task.

BRIEF DESCRIPTION OF THE DRAWINGS

FIG. 1 is a perspective view of the first form of the invention mounted on the back of a human hand.

FIG. 2 is a cross-sectional view of the gyroscope of FIG. 1.

FIG. 3 is a view taken along the line 3—3 of FIG. 2.

DETAILED DESCRIPTION OF THE INVENTION

Figure 4:
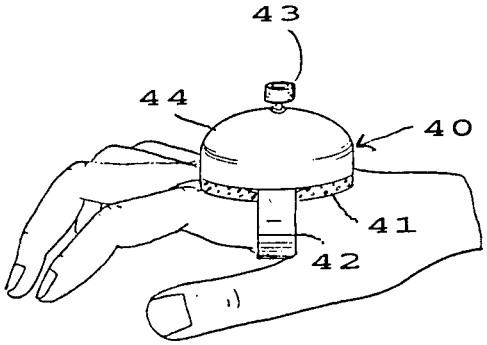
FIG. 4 is a perspective view of a modified form of one part of the invention.

FIG. 1 illustrates one form of the invention wherein gyroscopic apparatus 10 is held firmly against the back side of a human hand by a strap 11.

The device 10 comprises a firm pad 13 supporting a base 14, a casing 15, a gyroscope 16 having batteries 17 to increase the gyroscopic action due to their weight and their location near the periphery of gyroscope 16, wire 19, slip ring 20, shaft 21, wire 22, electric motor 23, sound deadening cushion 24, and switch 29.

When switch 29 is closed, current from the positive pole of the four batteries 17, which are connected in series, flows via wire 19, slip ring 20, wire 22, switch 29, motor 23, to ground and back to the negative pole of the batteries 17. Hence, motor 23 rotates gyroscopic disc 16. The four batteries 17 greatly increase the gyroscopic action since they are heavy objects located near the periphery of the gyroscopic disc 16.

The gyroscopic apparatus 10 is held firmly against the back side of the hand by straps 11 and 12 which are joined by Velcro connecting surfaces near their free ends. The pad 13 should not be rigid so it is easy to wear, but it is preferably firm so that the gyroscope 16, 17 will be firmly attached to the hand to thus reduce any tremor in the hand.

The apparatus is designed to reduce the noise that it might otherwise produce. In this regard cushion 24 prevents vibrations at the motor from reaching the casing 15. Casing 15, itself, is made of sound-deadening material. The pad 13 also tends to reduce noise.

The motor 23 is preferably a compound d.c. motor having a series field large enough to provide high speed at the shaft 21.

FIGS. 4 to 7 illustrate a modified form of the invention.

FIG. 4 shows gyroscopic apparatus 40 having pad 41 firmly connecting it to the back side of a human hand. Straps 42 and 45 which connect together with a Velcro fastener hold apparatus 40 in place.

Figure 5:
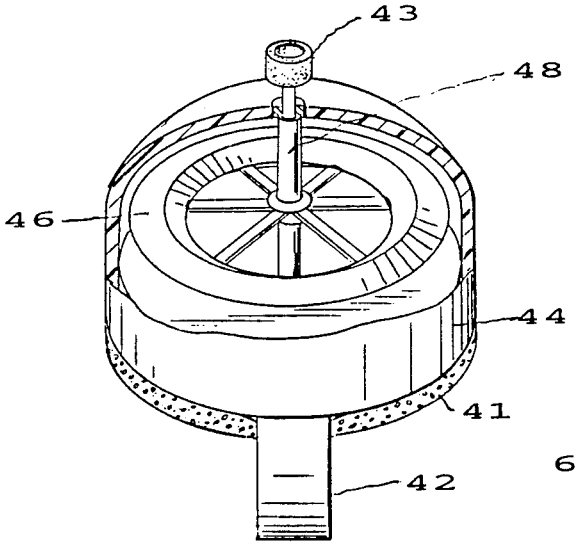
FIG. 5 is a perspective view of the gyroscope of FIG. 4 with part of the casing cut away.
Figure 6:
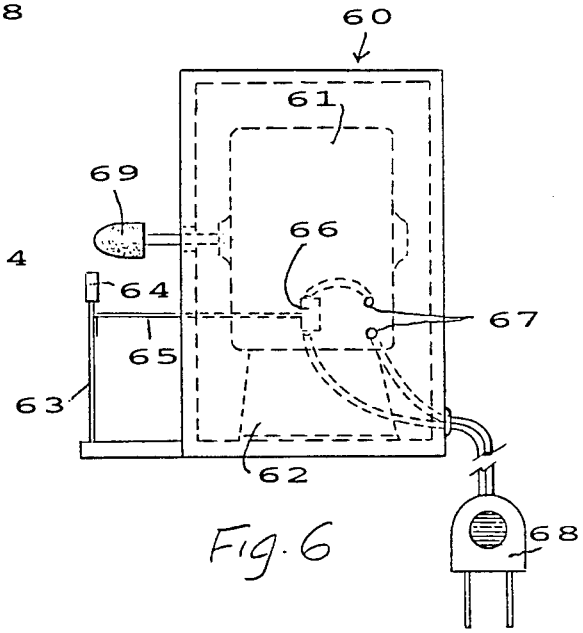
FIG. 6 is a side view of a motor for driving the gyroscope.
Figure 7:
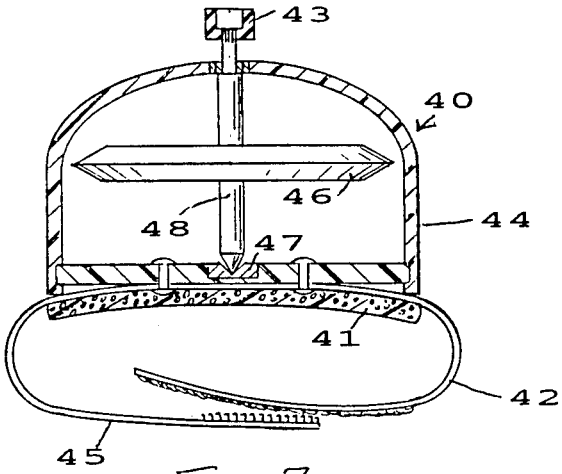
FIG. 7 is a cross-sectional view of the gyroscope of FIGS. 4 and 5.

FIGS. 5 to 7 show a gyroscope 46, heavily weighted at its periphery, having a shaft 48 rotating in bearing 47 and also having a rubber cup shaped tip 43 at the upper end of shaft 48. The apparatus is mounted in casing 44 which is supported, by pad 41, on the back side of a hand.

The apparatus of FIG. 6 drives the gyroscope 46 of FIGS. 5 and 7. The apparatus of FIG. 6 is a heavy device that rests on a table or other flat surface near where the person with essential tremor, or other tremor, works. A casing 60 has a motor 61 on a base 62, a resilient switch arm 63, a manual engagement member 64, a connecting rod 65 and a switch 65 for turning the motor 61 on and off. The motor 61 has input terminals 67 electrically connected to plug 68 through switch 65.

After the apparatus 10 is mounted on the back of the right hand, and when the person with a tremor desires to do delicate work, the person grasps his right hand with his left hand so that he may move cup 43 toward driving cone 69 (that is mounted on the shaft of motor 61). As the right hand approaches casing 60, it presses engagement member 64 toward the right, thus moving connecting rod 65 to close switch 66 starting motor 61. The person, with the help of his left hand, then moves cup 43 into engagement with cone 69. The motor 61 now drives gyroscope 46 at a very high speed.

The gyroscope 46 will coast after it is disengaged from motor 61 and holds the right hand steady insofar as the natural tremors are concerned. The powerful muscles of the right arm, and elsewhere, are, however, sufficiently powerful to override the gyroscopic action. The person may, therefore, for a short time (until the gyroscope 46 slows down), perform some useful tasks that he, otherwise, could not perform.

I claim to have invented:

1. Apparatus for reducing the effects of a tremor on a human hand, comprising:

means tending to hold said hand steady, said means including a gyroscope, a gyroscopic supporting means for said gyroscope, and attachment means for firmly attaching said supporting means to a human hand and for tending to hold said hand steady so that any tremor in said hand is reduced.

2. Apparatus as defined in claim 1, comprising:

an electric motor supported by said supporting means for rotating said gyroscope.

3. Apparatus as defined in claim 2, comprising:

at least one battery mounted on said gyroscope for providing electricity to run said motor.

4. Apparatus as defined in claim 3, having a shaft for said gyroscope and a slip ring on said shaft for conducting electricity from said battery to said motor.

5. Apparatus as defined in claim 4, comprising:

a casing carried by said attachment means, said casing including sound-deadening means to reduce the noise from said motor and gyroscope.

6. Apparatus as defined in claim 1, comprising:

said attachment means comprising means for holding said supporting means against the back side of a human hand.

7. Apparatus as defined in claim 1, in which said attachment means comprises strap means for extending around a human hand with said supporting means held against the back side of the human hand.

8. Apparatus as defined in claim 7, comprising:

a shaft for said gyroscope, an electric motor for driving said gyroscope, a battery, for energizing said motor, mounted on said gyroscope and means including a slip ring on said shaft for conducting electricity from said battery to said motor.

9. Apparatus as defined in claim 8, comprising:

casing means for at least partially deadening the sound from said motor and gyroscope, said casing means being mounted on said attachment means and substantially surrounding said motor and rotating therewith, and said gyroscope.

10. Apparatus as defined in claim 1, comprising:

an electric motor carried by said attachment means for driving said gyroscope.

11. A gyroscopic device comprising:

a gyroscope, means for mounting said gyroscope for rotation, at least one battery mounted on said gyroscope and rotating therewith, and a motor electrically connected to, and energized by, said battery for rotating said gyroscope.

12. A gyroscopic device as defined in claim 11, in which said battery is located near the periphery of said gyroscope 13. A gyroscopic device as defined in claim 12 comprising means for holding said gyroscopic device against a human hand, 14. The method of reducing a tremor in a human hand comprising:

providing a gyroscope for tending to render said hand steady, rotating said gyroscope, and attaching said gyroscope to a human hand, subject to tremor, for tending to render said hand steady and for reducing said tremor in said hand.

15. The method of claim 14 in which said attaching step comprises mounting said gyroscope on the back side of a human hand.

16. The method of claim 14 comprising providing an electric motor for driving said gyroscope.

17. Apparatus as defined in claim 1, comprising:

a motor mounted separate from said gyroscope, said supporting means and said attachment means, and means on said motor and additional means on said gyroscope for allowing said gyroscope to be rotated by said motor.

18. The method of claim 14 in which said tremor is an essential tremor.

19. The method of claim 14, comprising:

providing a rotating body that is not associated with said human being or said gyroscope, and rotating said gyroscope from said rotating body.

20. The method of claim 14, comprising:

providing an electric motor for rotating said gyroscope, and providing a battery near the periphery of said gyroscope and energizing said motor with current from said battery.

* * * * *